US009177732B2

(12) United States Patent
Cloran et al.

(10) Patent No.: US 9,177,732 B2
(45) Date of Patent: Nov. 3, 2015

(54) FLEXIBLE CABLE ASSEMBLY WITH IMPROVED MANUFACTURABILITY

(71) Applicant: ROCKWELL AUTOMATION TECHNOLOGIES, INC., Mayfield Heights, OH (US)

(72) Inventors: Shawn D. Cloran, Wauwatosa, WI (US); Edward Byaliy, Mequon, WI (US); Jerry M. Watkins, Franklin, WI (US); Scott B. Lasko, Pewaukee, WI (US); Christopher J. Wieloch, Brookfield, WI (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 192 days.

(21) Appl. No.: 14/078,199

(22) Filed: Nov. 12, 2013

(65) Prior Publication Data

US 2015/0131210 A1 May 14, 2015

(51) Int. Cl.
*H01H 3/02* (2006.01)
*H01H 3/38* (2006.01)
*H01H 3/20* (2006.01)

(52) U.S. Cl.
CPC . *H01H 3/02* (2013.01); *H01H 3/20* (2013.01); *H01H 3/38* (2013.01)

(58) Field of Classification Search
CPC ..... H01H 3/02; H01H 3/20; H01H 3/38; H01H 9/262; H01H 9/282; Y10T 307/74; H02B 1/38
USPC ..... 361/601, 602, 605, 622, 627, 631, 641, 361/643; 200/50.02, 50.33, 50.14, 330, 200/331, 332, 329, 337, 334; 335/68–72, 335/202; D13/110–112, 122–133, D13/158–161, 184
See application file for complete search history.

(56) References Cited

U.S. PATENT DOCUMENTS

| | | | | |
|---|---|---|---|---|
| 3,939,725 | A * | 2/1976 | Fisher | 74/503 |
| 4,626,638 | A * | 12/1986 | Samples et al. | 200/331 |
| 5,193,666 | A * | 3/1993 | Markowski et al. | 200/331 |
| 5,272,296 | A * | 12/1993 | Robarge et al. | 200/331 |
| 5,428,196 | A | 6/1995 | Beatty, Jr. et al. | |
| 5,973,279 | A * | 10/1999 | Turner et al. | 200/331 |
| 6,504,460 | B2 * | 1/2003 | DeGrazia et al. | 335/68 |
| 6,590,756 | B2 * | 7/2003 | Meiners et al. | 361/62 |
| 6,642,463 | B1 * | 11/2003 | Turner | 200/331 |
| 6,710,697 | B1 * | 3/2004 | Houck, III | 337/196 |

* cited by examiner

*Primary Examiner* — Michail V Datskovskiy
(74) *Attorney, Agent, or Firm* — Boyle Fredrickson, S.C.

(57) ABSTRACT

A remote switching system for electrical switches in a cabinet provides simplified manufacture by attaching the flexible cable sheath and flexible cable to an actuator frame and slider, respectively, by means of flange elements attached to each of the sheath and cable that fit within corresponding receiving slots in the actuator frame and contained slider. A cover, which may be attached without fasteners, may then hold these flange elements within corresponding slots.

19 Claims, 6 Drawing Sheets

FIG. 11
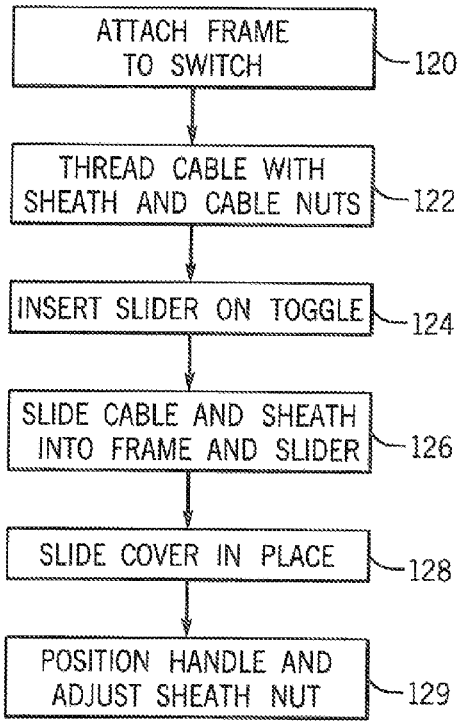
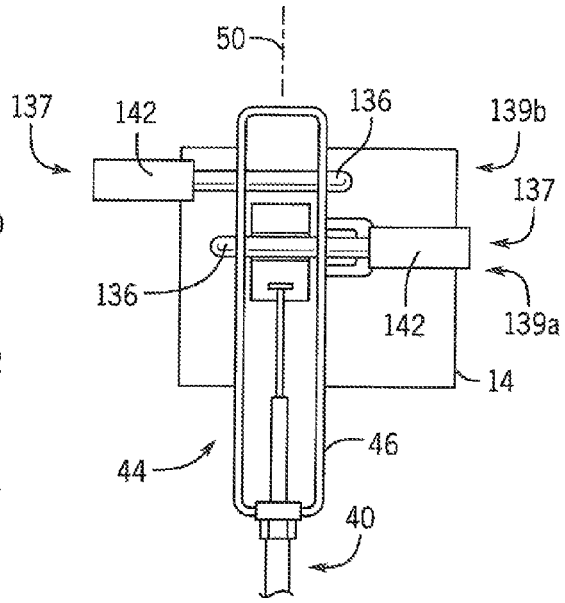
FIG. 12
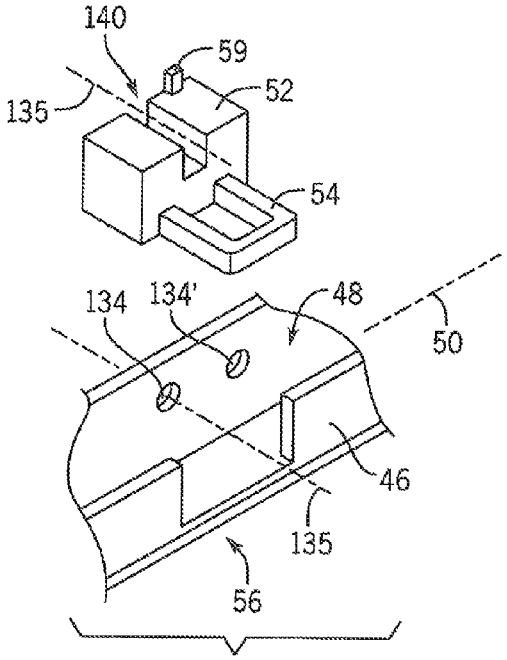
FIG. 13
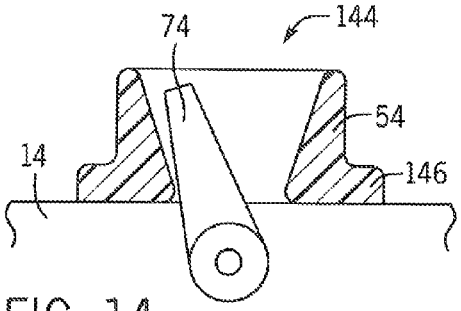
FIG. 14

FLEXIBLE CABLE ASSEMBLY WITH IMPROVED MANUFACTURABILITY

BACKGROUND OF THE INVENTION

The present invention relates to high-power electrical switches, and in particular to a flexible cable assembly for remotely actuating electrical switches such as circuit breakers.

High-power electrical circuitry is normally placed inside a metal cabinet to protect the electrical circuitry from the external environment and to shield users from potential hazards associated with the operation of the circuitry.

Often the cabinet provides a handle that serves both to lock a cabinet door and to disconnect electrical power from the interior circuitry before the door is opened. The handle may communicate through a flexible cable assembly with a switch inside the cabinet, for example, a circuit breaker, so that when the handle is moved to allow opening of the cabinet door, the circuit breaker is also opened, removing electrical power from the interior circuitry. This feature is normally subject to the mechanical override in the event that the cabinet must be operated with the door open and the circuitry live.

A flexible cable assembly provides a substantially incompressible sheath through which a flexible cable may slide. Opposite ends of the sheath are fixed, respectively, to a stationary structure of the handle and an actuator frame attached to the circuit breaker housing. One end of the flexible cable is then attached to a movable portion of the handle to communicate this motion through the flexible cable to a slider held within the actuator frame. The slider may provide a collar capturing a toggle operator of the circuit breaker to move the circuit breaker toggle between an "on" and "off" position with movement of the flexible cable by the handle.

The end of the flexible cable of the flexible cable assembly may attached to the slider by means of a pair of opposed jam nuts attached to a threaded ferrule on one end of the flexible cable. The jam nuts are tightened against either side of a hole in the flange on the slider. Likewise, the sheath of the flexible cable assembly may be attached to the actuator frame by means of a pair of opposed jam nuts also tighten on opposite sides of a hole through a flange on the actuator frame. In both cases, the jam nuts serve the dual purpose of attaching the cable or the sheaf to corresponding structure and allowing adjustment of the relative points of attachment for "tuning" the remote actuation system.

"Tuning" adjusts the separation of the points of attachment of the flexible cable and the sheath to corresponding structure of the actuator and slide so that a given range of motion of the handle is translated to positions of the toggle operator of the circuit breaker sufficient fully switch the circuit breaker between its "on" and "oft" positions.

Assembly of the jam nuts to the respective attachment points of the slider and/or attachment frame requires that one jam nut be removed so that the threaded shaft holding the jam nuts can be inserted through the hole in the flange. The removed jam nut is then reinstalled and the two jam nuts adjusted for proper positioning. This process is cumbersome and time-consuming but allows the necessary tuning.

This latter step of tightening the jam nuts can also be difficult requiring that the actuator frame be partially disassembled and that the person making the assembly work within the close confines of that framework to loosen and tighten these two nuts. Once the two jam nuts are properly positioned they must be tightened together using torque-controlled tools to ensure that the connection does not inadvertently loosen during vibration or use and to ensure that the torque is not so high as to damage the threaded barrel on the end of the sheath causing the sheath to separate from the actuator.

After moving the jam nuts, it can be difficult to determine whether the adjustment is correct because the handle may not be operated with the jam nuts loose such as would allow the sheath to move freely. Accordingly multiple trials may be required for proper adjustment.

The slider and adapter assembly may be formed of folded metal to provide the necessary mounting flanges needed for the jam nuts. These metal parts must be lubricated to prevent seizing of the sliding operation between few contact surfaces of the slider and the actuator frame. While these metal components are robust they are electrical conductors and must be used with care in the vicinity of electrical circuitry and with consideration of conduction from the actuator through the flexible cable to the handle and the cabinet.

SUMMARY OF THE INVENTION

The present invention provides a remote actuator system that may be more readily manufactured while still providing for the necessary "tuning" of the flexible cable assembly. In particular, the invention provides a slide and actuator frame element that may incorporate slots receiving flanged features on the flexible cable and sheath. During manufacture, the flexible cable may simply be dropped into the actuator frame with the flanged features being received by corresponding slots with no necessary removal or tightening of jam nuts. A multi surface engagement between the slider and the actuator frame allows reduced or lubricant free operation of these inter-engaging components when manufactured from thermoplastic materials. A snap-fit cover retains the flexible cable assembly within the actuator frame without the need to install multiple screws or the like.

Specifically, in one embodiment, the invention provides a remote switching assembly for use with an electrical switch having a switch operator movable along an actuation axis. The remote switching assembly includes an actuator frame presenting a longitudinal channel extending along a longitudinal axis and attachment elements for attaching the actuator frame to a housing of an electrical switch adjacent to the switch operator so that the longitudinal axis is substantially parallel to the actuation axis. A slider fits within the longitudinal channel of the actuator frame to slide therein along the longitudinal axis. A flexible cable assembly providing a sheath surrounding a flexible cable, the sheath and the flexible cable providing flange elements attached thereto and having features extending radially from axes of extension of the sheath and flexible cable. The actuator frame may provides a key way extending across the longitudinal axis receiving the flange element of the sheath to retain the sheath against movement in the longitudinal direction with respect to the actuator frame and the slider may provide a key way extending across the longitudinal axis receiving the flange element of the flexible cable to retain the flexible cable against movement in the longitudinal direction with respect to the slider.

It is thus a feature of at least one embodiment of the invention to provide a method of rapidly assembling an actuator frame that eliminates the laborious removal, adjustment, and torquing of jam nuts.

The key way in the actuator frame may provide two slots opposed perpendicularly to the longitudinal axis to retain opposed surfaces of the flange elements.

It is thus a feature of at least one embodiment of the invention to provide a slot system that distributes actuation forces to allow for robust construction of the slider and actuator frame from thermoplastic materials into which the necessary slots may be formed.

One flange element may be a flange of a threaded fastener attached to a threaded terminator on the sheath.

It is thus a feature of at least one embodiment of the invention to provide an attachment method compatible with adjustment of at least one flange element for tuning the remote actuation system.

The flange element may be further sized to threadably rotate about the threaded terminator within the key way.

It is thus a feature of at least one embodiment of the invention to permit tuning of the remote actuation system after assembly of the flexible cable.

One flange element may be a lock nut fixedly attached to a threaded end of the flexible cable.

It is thus a feature of at least one embodiment of the invention to simplify assembly by limiting adjustment to only the attachment point of the sheath. It is another feature of at least one embodiment to provide a simple method of attaching a flange element to the flexible cable.

The actuator frame may provide two components of an attachable blocking element and a channel element where the blocking element fits over at least one of the key ways of the slider and actuator frame to prevent removal of at least one of the flange elements of the sheath and cable when the removable blocking element is attached.

It is thus a feature of at least one embodiment of the invention to provide a simple method of retaining the flange elements against dislodgment.

The blocking element may fit over both of the key ways of the slider and actuator frame to prevent removal of at both flange elements of the sheath and cable when the removable blocking element is attached.

It is thus a feature released one embodiment of the invention to simultaneously lock in both flange elements.

The removable blocking element may be a cover fitting over the channel in the channel element of the actuator frame.

It is thus a feature of at least one embodiment of the invention to lock in the flange elements and to cover the slider against contamination or interference.

The cover may attach to the actuator frame by inter-engaging hook elements.

It is thus a feature of at least one embodiment of the invention to provide a simple fastener-less assembly technique for the cover.

The cover may include a snap detent preventing removal of the cover without manipulation of the snap detent element by a tool.

It is thus a feature of at least one embodiment of the invention to prevent inadvertent removal of the cover without requiring retaining screws or the like.

The cover may engage the hook elements by movement with respect to the channel in the longitudinal direction.

It is thus a feature of at least one embodiment of the invention to provide a removal direction that is not promoted by forces of the flange elements in dislodgment.

The slider element may include opposed first and second channels receiving corresponding rails in the actuator frame so that the sliding element has sliding contact between the first and second channels and the corresponding rails and between outer walls of the slider element and walls of the channel.

It is thus a feature of at least one embodiment of the invention to provide forced distributed construction allowing the actuation channel and slider to be constructed robustly of thermoplastic material. It is another feature of at least one embodiment of the invention to lessen the need for lubricants to prevent camming or jamming of the slider.

The above aspects of the invention are not intended to define the scope of the invention for which purpose claims are provided. In the following description, reference is made to the accompanying drawings, which form a part hereof and in which there is shown by way of illustration, and not limitation, a preferred embodiment of the invention. Such embodiment does not define the scope of the invention and reference must be made therefore to the claims for this purpose.

BRIEF DESCRIPTION OF THE DRAWINGS

Reference is hereby made to the following figures in which like reference numerals correspond to like elements throughout, and in which:

FIG. 11 is a flowchart of the manufacturing steps for assembling the switching system in one embodiment of the present invention;

FIG. 12 is a schematic representation of the actuator assembly and electrical switch showing alternative locations for a padlock for locking the slider and electrical switch in the off position;

FIG. 13 is an exploded perspective view of the actuator frame and slider showing multiple positions of locking holes and an optional slot in the slider; and FIG. 14 is a cross-sectional view through the collar of the slider taken along line 14-14 of FIG. 3 showing its funnel-like opening.

DETAILED DESCRIPTION OF THE INVENTION

Figure 1:
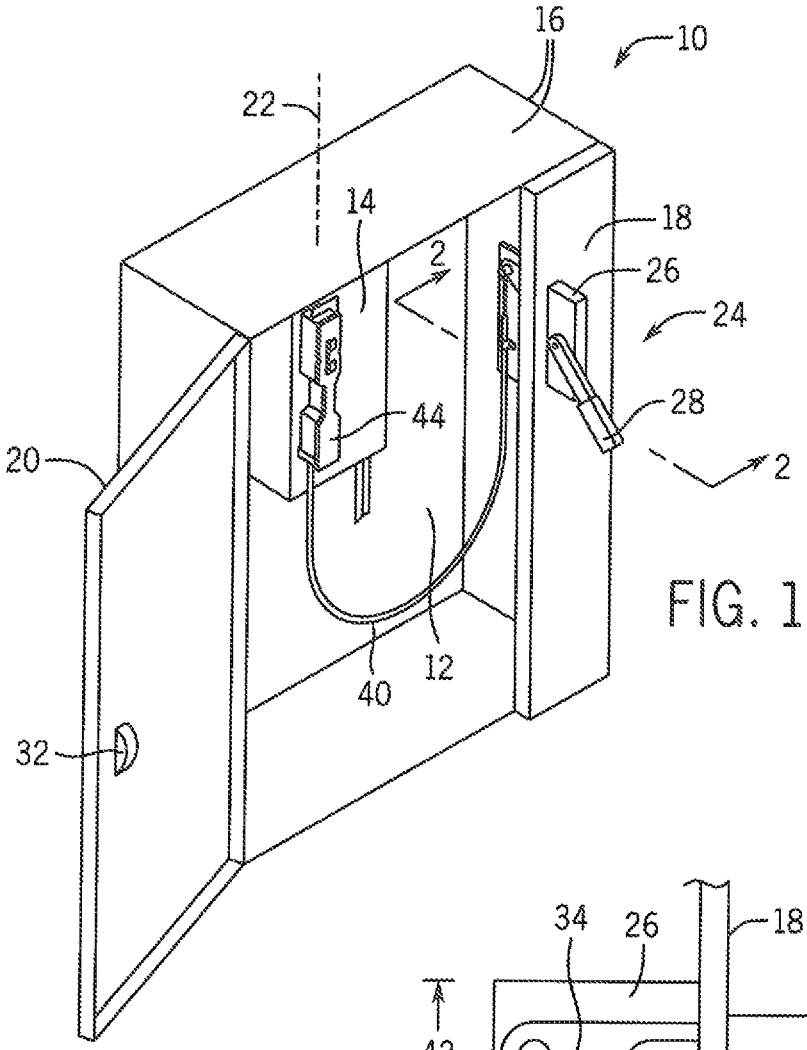
FIG. 1 is a simplified perspective view of an open electrical cabinet showing an exterior accessible handle assembly communicating by a flexible cable with an actuator assembly on an electrical switch.

Referring now to FIG. 1, an electronics cabinet 10, for example, constructed of sheet steel, may provide a generally rectangular rear wall 12 to which electrical equipment may be attached including an electrical switch 14 such as a circuit breaker, disconnect switch, or the like. Top and side walls 16 of the electronic cabinet 10 extend forward from the periphery of the rear wall 12 and may be covered by a combination of the front panel 18 and door 20 to define a cabinet interior. The door 20 may hinge between open and closed position, for example, along a hinge axis 22 at a front vertical edge of left side wall 16.

The front panel 18 may be fixed to one edge of the cabinet 10 against a left side wall 16 and spanning an upper and lower side wall 16 and may support a handle assembly 24. The handle assembly 24 may include a frame 26 supporting a pivoting handle 28 which may swing between an upper "on" position and a lower "off" position (the latter shown in FIG. 1) as manipulated by a user.

Figure 2:
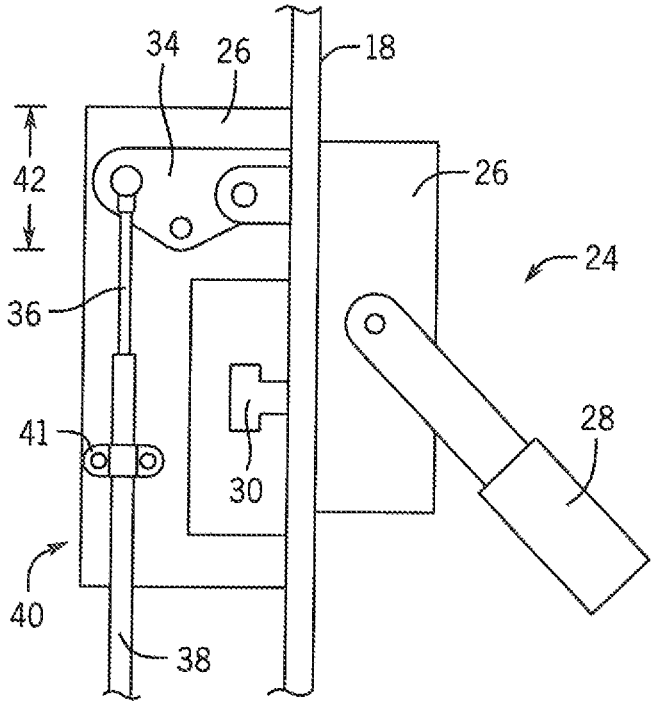
FIG. 2 is a side elevational view of the handle assembly showing attachment of the flexible cable to that assembly.

Referring also to FIG. 2, as is generally understood in the art, in the lower "off" position, a latch lever 30 interacting with a latch strike 32 on the door 20 may allow opening of the door 20 from a closed position. Conversely, when the handle 28 is in the upper "on" position, the latch lever 30 may interact with the latch strike 32 to hold the door closed in a locked position.

Generally, the movable handle 28 controls an actuation linkage 34 attached to a portion of the handle frame 26 inside the cabinet 10. This actuation linkage 34 in turn may be attached to a flexible cable 36 fitting within a tubular cable sheath 38 together forming a flexible cable assembly 40. The end of the sheath at the handle assembly 24 may be fixed by a clamp 41 to the handle frame 26 so that movement of the actuation linkage 34 by the handle 28 slides the flexible cable 36 within the sheath 38.

As is generally understood in the art, the flexible cable 36 and tubular cable sheath 38 may be relatively freely flexed across their axes of extension but are substantially resistant to changes in dimension in tension or compression along th-eir axes of extension to efficiently transmit the relative motion between the flexible cable 36 and the sheath 38 to a remote location. Generally, motion of the handle 28 through its entire range will provide for a relative movement between the flexible cable 36 and the cable sheath 38 of a predefined distance 42 as will be discussed further below. The actuation linkage 34 controls the relationship between the movement of the handle 28 and the desired predefined distance 42 of the flexible cable 36.

Referring again to FIG. 1, flexible cable assembly 40 may pass through the interior of the cabinet 10 to an actuator assembly 44 attached to a front face of the electrical switch 14.

Figure 3:
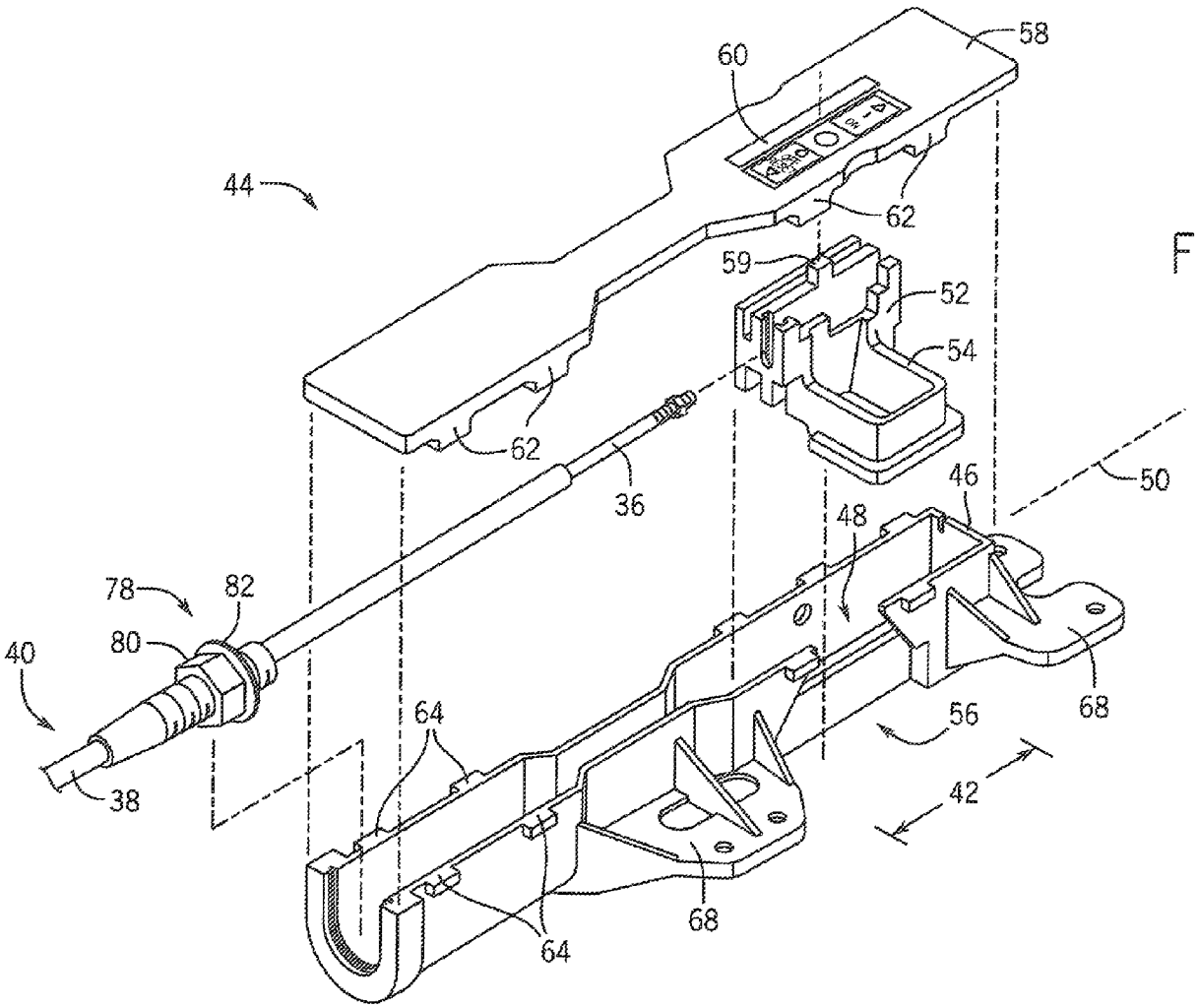
FIG. 3 is an exploded perspective view of the actuator assembly showing the components of an actuator frame, a slider, and a cover as may together secure an end of the flexible cable.

Referring now to FIG. 3, the actuator assembly 44 generally provides an actuator frame 46 presenting a generally upwardly open channel 48 extending along an actuation axis 50. A slider 52 may fit in an upper length of the channel 48 to slide therealong and may provide a sidewardly extending collar 54 projecting through an opening 56 in the side wall of the channel of the actuator frame 46. The size of the opening 56 is such as to permit the slider 52 to slide at least by the predefined distance 42 described above.

The cable assembly 40 may attach to a lower end of the actuator frame 46 (as will be discussed below) so that the flexible cable 36 extending through the sheath 38 may pass into the channel 48 along the actuation axis 50 to attach to the slider 52. As so assembled, movement of the flexible cable 36 will move the slider 52 along the actuation axis 50 within the actuator frame 46.

When the slider 52 is within the channel 48 and the cable assembly 40 attached to the actuator frame 46, an actuator frame cover 58 may be installed to cover the upper opening of the channel 48 and a portion of the cable assembly 40 within that channel 48. With the actuator frame cover 58 in place, the collar 54 remains uncovered, projecting from the side of the actuator frame 46.

A fiducial feature 59 of the slider 52 may project upward through a slot 60 in the actuator frame cover 58 so that the relative position of the slider 52 within the actuator frame 46 may be visually determined through the actuator frame cover 58. Generally, the actuator frame cover 58 may be attached to the actuator frame 46 by sliding engagement between a set of downwardly extending hooks 62 on the actuator frame cover 58 and laterally outwardly extending hooks 64 at an upper edge of the channel 48 of the actuator frame 46, as will be discussed in more detail below.

Figure 4:
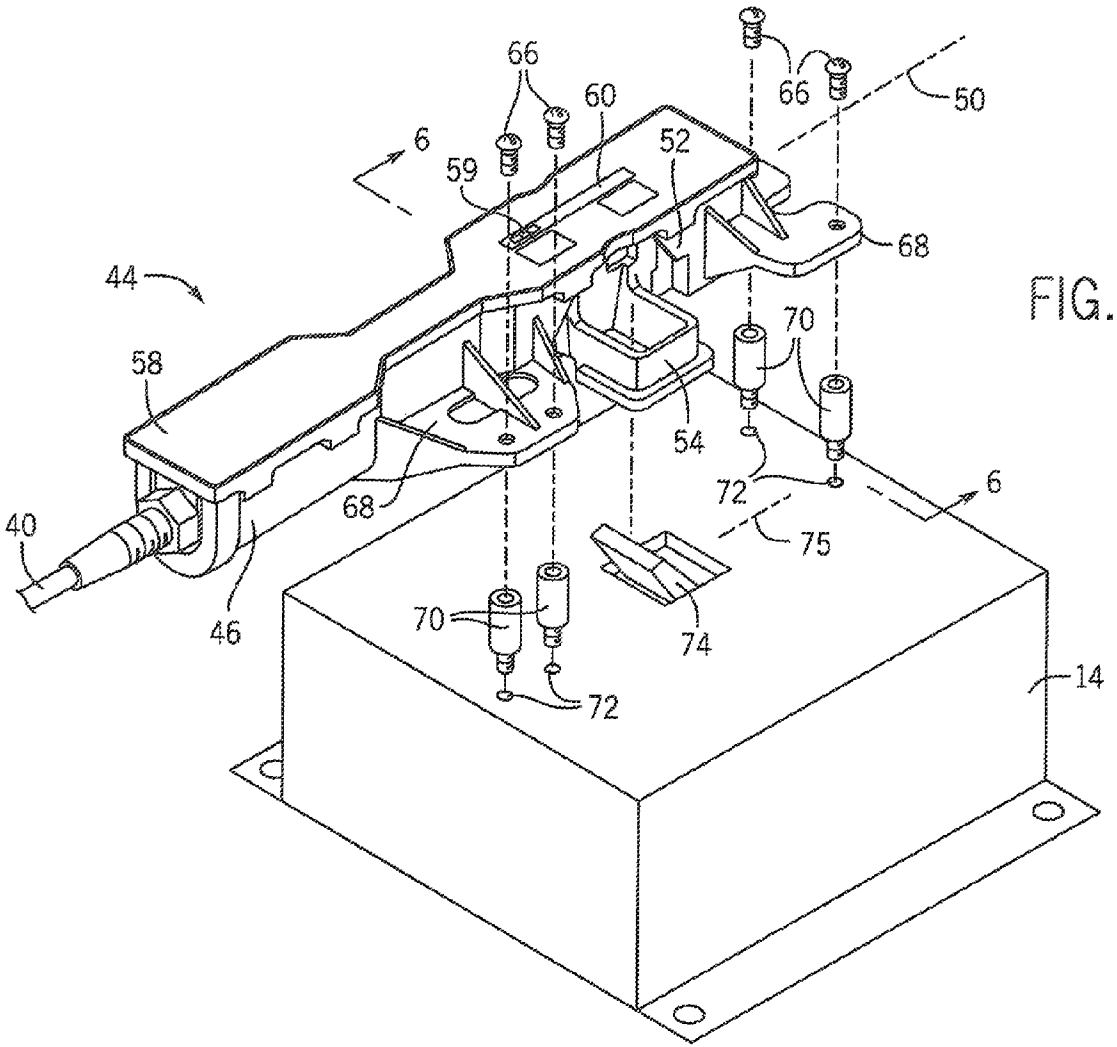
FIG. 4 is an exploded view of the assembled actuator assembly positioned with respect to the electrical switch for attachment thereto.

Referring also to FIG. 4, the actuator frame 46 may be attached to a front face of the electrical switch 14 by means of machine screws 66 passing through holes in horizontally extending flanges 68 in the actuator frame 46 and then through standoffs 70 to threaded bores 72 in the front face of the switch 14. When the actuator frame 46 is so attached, the collar 54 of the slider 52 surrounds an upwardly extending toggle operator 74 of the electrical switch 14 that may swing or toggle along a toggle operation axis 75. The toggle operation axis 75 is aligned with the actuation axis 50 of the actuator frame 46 when the actuator frame 46 is attached to the housing of the electrical switch 14.

This inter-engagement of the toggle operator 74 is such as to allow movement of the slider 52 and collar 54 to fully actuate electrical switch 14, moving the toggle operator 74 between an "on" position in which electrical current is conducted through the electrical switch 14 and "off" position in which electrical current is interrupted, when the slider 52 moves by the predefined distance 42.

Each of the slider 52, actuator frame cover 58, and actuator frame 46 may be constructed of injection molded thermoplastic having a high electrical dielectric to resist electrical conduction through these components to the flexible cable 36 should electrical power be applied to any of these components.

Figure 5:
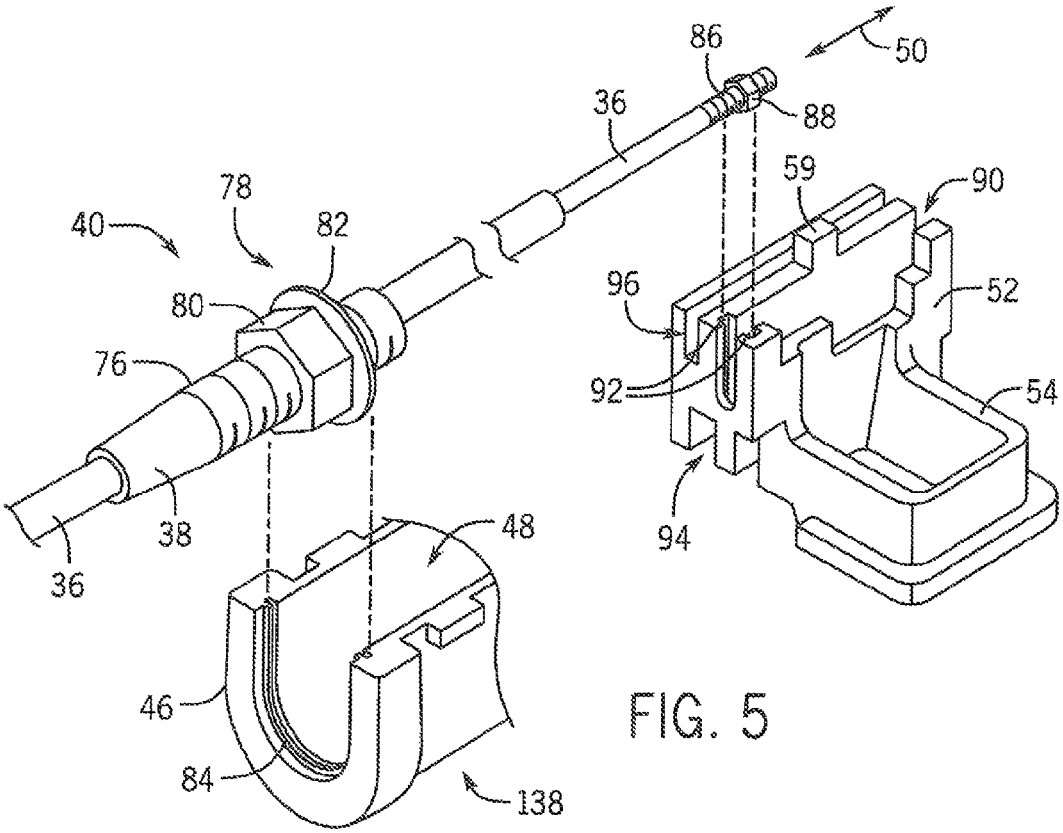
FIG. 5 is a fragmentary perspective view of an end of the actuator assembly and the slider showing interfacing of a threaded fastener on the flexible cable sheath to the actuator assembly and a lock nut on the flexible cable to the slider.

Referring now to FIG. 5, the end of the cable assembly 40 which is attached to the actuator frame 46 may provide a threaded ferrule 76, for example, crimped to an outer surface of the sheath 38 to present threads on its outer diameter. A threaded fastener 78 comprising, for example, a hex nut 80 having a radially projecting circular flange 82 attached at one face of the hex nut 80 may be received on the threaded ferrule 76. The hex nut 80 may, in one example, provide for opposed flats receivable by a standard open end wrench and separated by three-quarters of an inch or approximately 19 mm to be readily adjusted with common wrench sizes.

The radially projecting circular flange 82 may be substantially cylindrical like a washer and of greater diameter than the diameter of a circle circumscribing the flats of the hex nut 80. For example, the circular flange 82 may have a diameter of 1 inch and an axial thickness of approximately 9/16 of an inch. The lower end of the actuator frame 46 may provide a U-shaped groove 84 of equal diameter to the circular flange 82 that may receive the circular flange 82 while allowing the hex nut 80 to extend outward from the actuator frame 46 to be readily accessible. The U-shaped groove 84 is sized to permit free rotation of the circular flange 82 therein but to substantially resist translation of the circular flange along the actuation axis 50.

It will be appreciated that rotation of the threaded fastener 78 will move the threaded fastener along the threaded ferrule 76 adjusting the relative point of attachment of the sheath 38 to the actuator frame 46 as will be discussed further below.

When the actuator frame cover 58 of FIG. 3 is on the actuator frame 46, the circular flange 82 is captured between the groove 84 and underside of the actuator frame cover 58 blocking movement of the circular flange 82 against substantial upward movement and removal.

Referring still to FIG. 5, the end of the flexible cable 36 extending from the sheath 38 within the channel 48 may be threaded with threads 86 to receive a lock nut 88 designed to stay substantially fixed on the threads 86 once the lock nut 88 and threads 86 are engaged. A wide variety of lock nuts of this type are known including those with jamming threads or deforming features that engage the threads 86. The lock nut 88 may be received within a channel 90 of the slider 52 opening upward and having a laterally extending key way with opposed slots 92 that capture the axially opposed faces of the lock nut 88 against movement along actuation axis 50 with respect to the slider 52. Thus, movement of the flexible cable 36 within the sheath 38 will move the slider 52.

Figure 6:
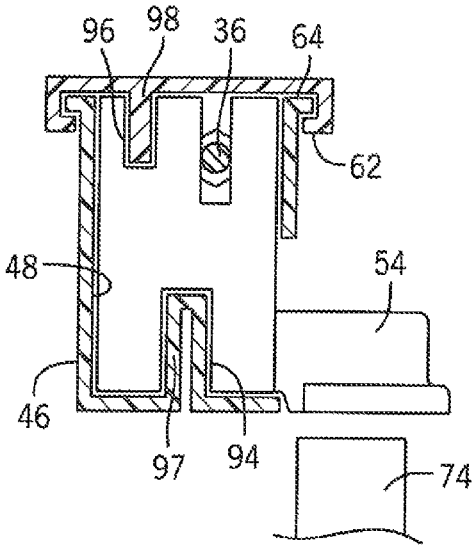
FIG. 6 is a cross-sectional view along line 6-6 of FIG. 4 showing opposed channels in the slider and rails on the actuator frame and actuator cover for guiding the slider.

Referring now also to FIG. 6, the slider 52 may have a lower axial channel 94 and upper axial channel 96 on opposed lowering upper faces of the slider 52 extending generally parallel to the actuation axis 50. The lower axial channel 94 and upper axial channel 96 may each engage a corresponding axial guide rail 97 with axial guide rail 97 extending upward from a bottom of the channel 48 of the actuator frame 46 and guide rail 98 extending downward from the underside of the actuator frame cover 58. These two rails 97 and 98 provide a low friction interface of plastic on plastic allowing smooth sliding action of the slider 52 within the channel 48 of the actuator frame 46 and resist any rocking or torquing action that might jam or cam the two surfaces.

Figure 7:
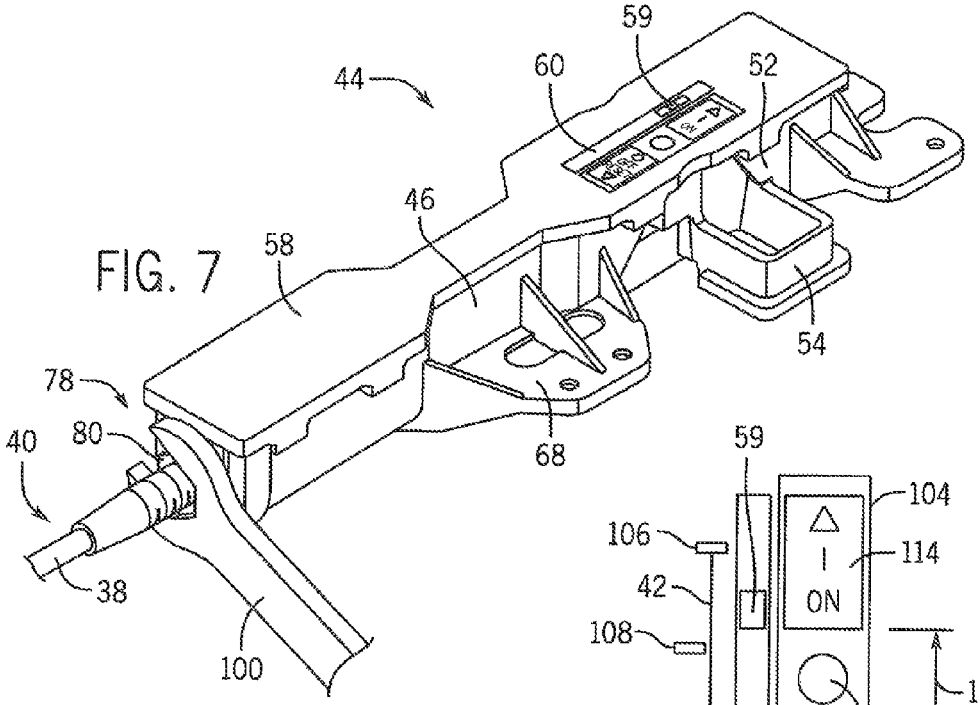
FIG. 7 is a perspective view of the assembled actuator assembly showing location of a wrench during the tuning process which may be accomplished with a simple adjustment of the threaded fastener alone.
Figure 8:
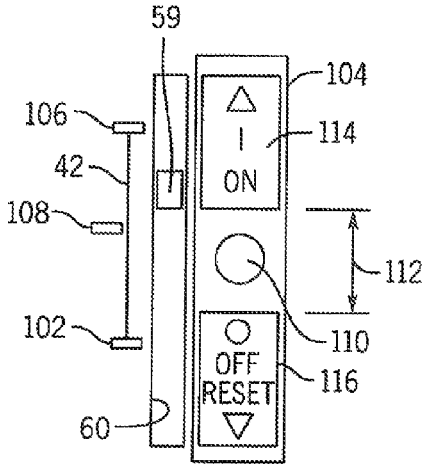
FIG. 8 is a top plan view of a label on the cover for identifying the position of the slider within the actuator assembly visible through a slot next to the label.

Referring now to FIGS. 7 and 8, adjustment of the threaded fastener 78 may be conducted by placing a standard open end wrench 100 on the hex nut 80 which protrudes from out of the assembled actuator frame 46 and actuator frame cover 58. This process is normally conducted by the manufacturer but can also be performed by the end-user. In order to make this adjustment, the handle 28 (shown in FIG. 1, but typically a jig when this is done in a manufacturing environment) may be moved to the "off" position and an off extreme point 102 may be established with respect to a visual scale 104 printed on an upper surface of the actuator frame cover 58 along slot 60 through which the fiducial feature 59 may be viewed. The off extreme point 102 may be a center point of the fiducial feature 59 when the handle 28 is in the "off" position.

The handle 28 may then be moved to the "on" position and the on extreme point 106 established with respect to the scale 103. The predefined distance 42 will be the distance between the on extreme point 106 and the off extreme point 102. The threaded fastener 78 may then be adjusted to move a center point 108 between the off extreme point 102 and on extreme point 106 to be approximately centered at a center point 110 of the visual scale 104. The tuned assembly is then sent to the user who normally need not adjust the threaded fastener 78 on-site.

The visual scale 104 includes a dead zone 112 about the center point 110 indicating the region where the position of the toggle operator 74 shown in FIG. 4 cannot reliably be known to be in either the "on" or "off" position because of normal manufacturing tolerances in the operation of the electrical switch 14, play between the collar 54 and the toggle operator 74, play between the axial location of the actuator frame cover 58 and the actuator frame 46 and other tolerance factors. Above the dead zone 112 will be an on zone 114 indicating a position of the fiducial feature 59 when the electrical switch 14 is reliably in the on state. This on zone 114 may be marked with a color red, indicating the hazard of active electrical components within the cabinet 10, and the symbols for the on state including the international symbol of an I and the word "on". Below the dead zone 112 will be an off zone 116 which may be labeled in a green color and include the international symbol for off of O, the word "off" and the word "reset".

Figure 9:
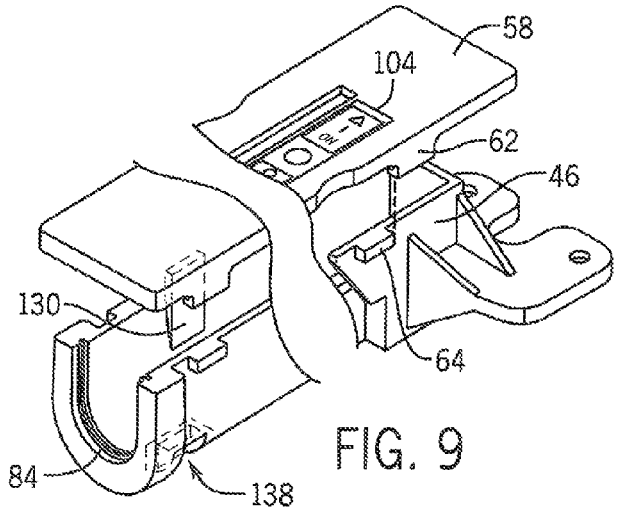
FIG. 9 is a fragmentary exploded view of the actuator frame and the actuator cover showing interlocking hooks that allow assembly of the two with a simple sliding motion.
Figure 10:
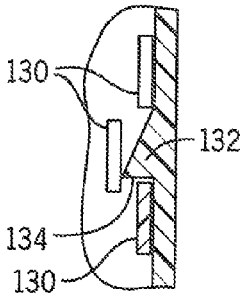
FIG. 10 is a schematic top plan diagram of the locking tab showing its operation.

Referring now to FIGS. 9 and 10, the configuration of the components described above greatly simplifies assembly of the actuator assembly 44, flexible cable assembly 40, and handle assembly 24 as well as assembly within a system as shown in FIG. 1 including electrical switch 14 and cabinet 10.

In that assembly process conducted at the manufacturer, the actuator frame 46 is first attached to the switch 14 as discussed above with respect to FIG. 4 and as indicated by process block 120. At this time, both the actuator frame cover 58 and the cable assembly 40 may be removed making this attachment process relatively simple by eliminating the weight and/or torque imparted by these additional components.

As indicated by process block 122, the threaded fastener 78 may then be assembled onto the threaded ferrule 76 as shown in FIG. 5 and the lock nut 88 may be attached to the threads 86 on the flexible cable 36 as shown in FIG. 5.

At process block 124, the slider 52 may be inserted into the channel 48 so that the collar 54 fits around the toggle operator 74 as shown in FIG. 4. Per process block 126, the threaded fastener 78 may then be inserted into the groove 84 of the actuator frame 46 and, as indicated by process block 128, the actuator frame cover 58 installed on the actuator frame 46 and the nut 88 inserted into the slots 92 of the slider 52. it will be understood that in some cases these steps may be duplicated by the end-user in the event of repair or tuning.

Referring now to FIGS. 6 and 9, the installation of the actuator frame cover 58 on the actuator frame 46 may be accomplished by simply placing the actuator frame cover 58 down against the upper edge of the actuator assembly 44 so that the hooks 62 may pass past the hook 64 discussed above with respect to FIG. 3. The actuator frame cover 58 may then be moved axially to engage hooks 62 and 64 which serve to prevent lifting off of the actuator frame cover 58.

The actuator frame cover 58 may include a downwardly extending lock tab 130 that passes over a locking ramp 132 on an inner vertical wall of the actuator frame 46 near groove 84. As shown in FIG. 10, axial sliding of the actuator frame cover 58 moves the lock tab 130 over the interior ramp 132 causing it to deflect inward and then spring outward against the perpendicular face 134 of the ramp 132 preventing retraction of the actuator frame cover 58 under normal use. Retraction of the actuator frame cover 58 can be provided by the insertion of a screwdriver blade 135 through an aperture 138 in the bottom of the channel 48 of the actuator frame 46 to pry the lock tab 130 over ramp 132 allowing the actuator frame cover 58 to be released.

Referring again to FIG. 10, in a final step 129, the handle 28 may be positioned successively in its "on" and "off" positions and the threaded fastener 78 adjusted as described above with respect to FIG. 8.

Referring now to FIGS. 1, 11, and 12, in one embodiment, a lock aperture 138 may be provided in one vertical wall of the actuator frame 46 providing a transverse path 135 perpendicular to actuation axis 50 through aperture 138 and opening 56 in the actuator frame 46. This transverse path 135 allows for the insertion of the shank 136 of a padlock 137 through the actuator assembly 44. In a first position 139*a*, the shank 136 may pass through a transverse slot 140 in the slider 52, when the slider 52 is in the off position, to lock the slider 52 against motion that would allow movement of the collar 54 or the toggle operator 74 (shown in FIG. 4).

Alternatively, in a second position 139*b*, the aperture 138 may be moved to position 134' so that the shank 136 of the padlock 137 may pass adjacent to an upper wall of the slider 52 to prevent movement of the slider 52 toward the "on" position, yet without requiring slot 140.

As shown in FIG. 11, a body 142 of the padlock 137 may be positioned on either side of the frame 46 for flexible access to a key slot or combination operator of the padlock 137. The use of a padlock 137 directly on the actuator assembly 44 provides additional security against inadvertent activation of the switch 14, the latter as may be accessible through the cabinet door 20 when the handle 28 is in the "off" position.

Referring to FIG. 13, the collar 54 may provide an opening 144 through which the toggle operator 74 extends that narrows downward toward the electrical switch 14, like a funnel, to the substantially equal opening with two times the width of the toggle operator 74 at its entrance into the collar 54. In this way, the collar 54 not only serves to move the toggle operator 74 but, when locked, prevents movement of the toggle operator 74 while still accommodating the pivoting action of the toggle operator 74.

A lower portion of the collar 54 may be expanded in a flange 146 to provide a stabilizing surface that rests against the upper surface of the switch 14 for improved stability. Generally, in the locked position, the machine screws 66 (shown in FIG. 4) will still be accessible allowing removal of the actuator assembly 44 in the event of an inability to remove the padlock at a time when recommissioning of the switches is desired.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

It is specifically intended that the present invention not be limited to the embodiments and illustrations contained herein and the claims should be understood to include modified forms of those embodiments including portions of the embodiments and combinations of elements of different embodiments as come within the scope of the following claims. All of the publications described herein, including patents and non-patent publications, are hereby incorporated herein by reference in their entireties.

We claim:

1. A remote switching assembly for use with an electrical switch having a switch operator movable along an actuation axis, the remote switching assembly comprising:

an actuator frame presenting a longitudinal channel extending along a longitudinal axis and attachment elements for attaching the actuator frame to a housing of an electrical switch adjacent to the switch operator so that the longitudinal axis is substantially parallel to the actuation axis;

a slider fitting within the longitudinal channel of the actuator frame to slide therein along the longitudinal axis, the slider providing a collar receiving the switch operator when the actuator frame is fixed to the housing of the electrical switch, so that movement of the slider along the actuation axis may switch the switch operator between on and off states;

a flexible cable assembly providing a sheath surrounding a flexible cable, the sheath and the flexible cable providing flange elements attached thereto and having features extending radially from axes of extension of the sheath and flexible cable;

wherein the actuator frame provides a key way extending across the longitudinal axis receiving the flange element of the sheath to retain the sheath against movement in the longitudinal direction with respect to the actuator frame and the slider provides a key way extending across the longitudinal axis receiving the flange element of the flexible cable to retain the flexible cable against movement in the longitudinal direction with respect to the slider.

2. The remote switching assembly of claim 1 wherein the key way in the actuator frame provides two slots opposed perpendicularly to the longitudinal axis to retain opposed surfaces of the flange elements.

3. The remote switching assembly of claim 2 wherein one flange element is a flange of a threaded fastener attached to a threaded terminator on the sheath.

4. The remote switching assembly of claim 3 wherein the flange element is sized to threadably rotate about the threaded terminator within the key way.

5. The remote switching assembly of claim 2 wherein one flange element is a lock nut fixedly attached to a threaded end of the flexible cable.

6. The remote switching assembly of claim 1 wherein the actuator frame provides an attachable blocking element and a channel element where the blocking element fits over at least one of the key ways of the slider and actuator frame to prevent removal of at least one of the flange elements of the sheath and cable when the attachable blocking element is attached.

7. The remote switching assembly of claim 6 wherein the blocking element fits over both of the key ways of the slider and actuator frame to prevent removal of at both flange elements of the sheath and cable when the removable blocking element is attached.

8. The remote switching assembly of claim 6 wherein the removable blocking element is a cover fitting over the channel in the channel element of the actuator frame.

9. The remote switching assembly of claim 8 wherein the cover attaches to the actuator frame by inter-engaging hook elements.

10. The remote switching assembly of claim 9 wherein the cover includes a snap detent preventing removal of the cover without manipulation of the snap detent element by a tool.

11. The remote switching assembly of claim 9 wherein the cover engages the hook elements by movement with respect to the channel in the longitudinal direction.

12. The remote switching assembly of claim 1 wherein the slider includes opposed first and second channels receiving corresponding rails in the actuator frame so that the slider has sliding contact between the first and second channels and the corresponding rails and between outer walls of the slider and walls of the channel.

13. The remote switching assembly of claim 1 wherein the sheath and flexible cable are substantially resistant to extension in tension and contraction in compression.

14. The remote switching assembly of claim 1 further including handle mechanism that is mountable to a cabinet surface having a handle frame and a handle movable with respect to the handle frame between a first position and a second position and wherein a second end of the sheath is attached the handle frame and a second end of the flexible cable is attached to the handle so that movement of the handle between the first position and second position move the slider in a range sufficient to switch the switch operator between the on and off states.

15. The remote switching assembly of claim 1 wherein the actuator frame and the slider are injection molded thermoplastic.

16. The remote switching assembly of claim 1 wherein the attachment elements are flange portions of the actuator frame having holes for receiving machine screws to attach the actuator frame to the electrical switch.

17. An electrical switching station for controlling electrical power comprising:

a cabinet providing an interior volume accessible through a cabinet door when the cabinet doors open;

at least one electrical switch attached to the cabinet within the interior volume, the electrical switch having a switch operator extending from a front of a housing of the electrical switch and movable along an actuation axis to switch the electrical switch between an on and off state;

an actuator frame presenting a longitudinal channel extending along a longitudinal axis and attachment elements for attaching the actuator frame to a housing of an electrical switch adjacent to the switch operator so that the longitudinal axis is substantially parallel to the actuation axis;

a slider fitting within the longitudinal channel of the actuator frame to slide therein along the longitudinal axis, the slider providing a collar receiving the switch operator when the actuator frame is fixed to the housing of the electrical switch, so that movement of the slider along the actuation axis may switch the switch operator between on and off states;

a flexible cable assembly providing a sheath surrounding a flexible cable, the sheath and the flexible cable providing flange elements attached thereto and having features extending radially from axes of extension of the sheath and flexible cable;

wherein the actuator frame provides a key way extending across the longitudinal axis receiving the flange element of the sheath to retain the sheath against movement in the longitudinal direction with respect to the actuator frame and the slider provides a key way extending across the longitudinal axis receiving the flange element of the flexible cable to retain the flexible cable against movement in the longitudinal direction with respect to the slider.

18. A method of adjusting an electrical switch as may be disposed in a cabinet having a door, the electrical switch having a switch operator extending from a front of a housing of the electrical switch movable along an actuation axis to switch the electrical switch between an on and off state, using an apparatus including:

an actuator frame providing a cover and an actuation channel the latter presenting a longitudinal channel extending along a longitudinal axis and attachment elements for attaching the actuator frame to a housing of an electrical switch adjacent to the switch operator so that the longitudinal axis is substantially parallel to the actuation axis;

a slider fitting within the longitudinal channel of the actuator frame to slide therein along the longitudinal axis, the slider providing a collar receiving the switch operator when the actuator frame is fixed to the housing of the electrical switch, so that movement of the slider along the actuation axis may switch the switch operator between on and off states;

a flexible cable assembly providing a sheath surrounding a flexible cable, the sheath and the flexible cable providing flange elements attached thereto and having features extending radially from axes of extension of the sheath and flexible cable;

wherein the actuator frame provides a key way extending across the longitudinal axis receiving the flange element of the sheath to retain the sheath against movement in the longitudinal direction with respect to the actuator frame and the slider provides a key way extending across the longitudinal axis receiving the flange element of the flexible cable to retain the flexible cable against movement in the longitudinal direction with respect to the slider; the method comprising the steps of:

(a) placing the slider within the longitudinal channel;

(b) sliding the flange element of the sheath into the key way on the actuator frame and sliding the flange element of the flexible cable into the key way of the slider; and (c) attaching the cover to the actuation channel to prevent this lodgment of the flange elements from the actuator frame and slider.

19. The method of claim 18 wherein the flange element on the sheath is a threaded fastener attached to a threaded terminator on the sheath and is sized to threadably rotate about the threaded terminator within the key way and further including the step of:

(d) rotating the threaded fastener to adjust a position of the slider within the actuator frame for a given extension of the flexible cable from the sheath.

* * * * *